United States Patent [19]

Nagae

[11] Patent Number: 4,983,058

[45] Date of Patent: Jan. 8, 1991

[54] TAPE HOLDING CASE

[75] Inventor: Tuyoshi Nagae, Nagoya, Japan

[73] Assignee: Brother Kogyo Kabushiki Kaisha, Nagoya, Japan

[21] Appl. No.: 422,010

[22] Filed: Oct. 16, 1989

[30] Foreign Application Priority Data

Oct. 17, 1988 [JP] Japan ..... 63-135275

[51] Int. Cl.[5] ..... B41J 35/36

[52] U.S. Cl. ..... 400/249; 400/207

[58] Field of Search ..... 400/207, 249

[56] References Cited

U.S. PATENT DOCUMENTS

| | | | |
|---|---|---|---|
| 2,174,351 | 12/1936 | Neidich | 400/249 |
| 4,115,013 | 9/1978 | Hedstrom | 400/249 |
| 4,636,097 | 1/1987 | Goubeaux | 400/249 |
| 4,863,297 | 9/1989 | Fujii | 400/249 |

FOREIGN PATENT DOCUMENTS

| | | | |
|---|---|---|---|
| 272232 | 6/1988 | European Pat. Off. . | |
| 58-59886 | 4/1983 | Japan . | |
| 0162580 | 7/1987 | Japan | 400/249 |
| 11104359 | 12/1987 | Japan . | |
| 63-101555 | 7/1988 | Japan . | |
| 1499152 | 2/1975 | United Kingdom . | |
| 1529949 | 11/1975 | United Kingdom . | |

OTHER PUBLICATIONS

U.S. Ser. Nos. 291,286 and 291,143 filed on Dec. 28, 1988.

*Primary Examiner*—Edgar S. Burr
*Assistant Examiner*—Ren Yan
*Attorney, Agent, or Firm*—Kane, Dalsimer, Sullivan, Kurucz, Levy, Eisele and Richard

[57] ABSTRACT

In a tape holding case including two or three tapes in wound states and at least one of tapes is arranged to be fed out and the other of tapes is arranged to be taken up in the case, a visually distinguishable portion is provided at a trailing end of the tape to be fed out. The distinguishable portion is fed out before the other of tapes is completely taken up within the tape holding case.

Thus, the one of tapes is not travelled without taking up operation of the other of tapes if an operator ceases the feeding operation after confirming the fed out predetermined portion.

15 Claims, 4 Drawing Sheets

TAPE HOLDING CASE

BACKGROUND OF THE INVENTION

The present invention relates to a tape holding case including at least two different tapes being fed in association with each other, one of which is made visible after being fed out from the case, and more particularly to a tape holding case arranged to be mounted on a tape printer unit for producing a labeling tape, which is to be stuck to a suitable object after having arbitrary characters and symbols printed thereon for desired labeling on a transfer tape for lettering design which is pressed against a suitable object to transfer information to it.

A case unit for producing labeling tapes and transfer tapes typically includes two or three different tapes stored within the cases as disclosed in Utility Model Application Sho 62-199662.

In its use, these tapes are fed out in association with one another to achieve their own functions.

However, it sometimes happens in such a tape holding case that, one of the two tapes travels though the other of tapes has been already fed out. Looking at the tape being fed out, an operator sees it possible to operate printing or the like and continues on such processing, thereby causing some abnormality in the printer unit.

Assume that the tape holding case is for the lettering purpose housing therein a print tape and an ink ribbon to be thermally transferred to the print tape. In this tape holding case, the ink ribbon is included in the case is in a wound state and taken up onto a spool provided within the case. Since the print tape along is fed out from the tape holding case, the print tape is still being fed out if the ink ribbon is completely taken up. This makes an operator believe there is no such abnormality as to cease the printing operation.

Since the ink ribbon has already stopped feeding, the stationary print head keeps heating one spot of the ink ribbon, while the print tape runs along the back side thereof developing continuous friction against the ink ribbon. As a result, the ink ribbon is often broken and tangled within the case or in the printer unit, or the print head may be soiled with the molten ink on the ink ribbon. Furthermore, overheat at the motor taking up the ink ribbon is very likely to cause some trouble in the printer unit.

Especially, the ink ribbon can usually be taken up manually by the operator to avoid slackening. This makes the aforementioned problem easy to be encountered even if the print tape and the ink ribbon has the same length.

SUMMARY OF THE INVENTION

It is therefore an object of the invention to provide an improved tape holding case capable of avoiding trouble caused by an earlier termination of the feeding of one of tapes as compared to the other tapes.

For this purpose, according to this invention, there is provided a tape holding case being attachably and detachably mounted on a tape feed device and including at least two tapes arranged to be contacted with each other at least at a predetermined position in the tape holding case, one of said two tapes being fed toward the outside of the tape holding case by a roller member provided on the tape feed device and the other of the two tapes being taken up onto an another roller member provided within the tape holding case, after the two tapes are contacted, the one of the two tapes includes a visually distinguishable predetermined portion at a ending side having a predetermined relationship with the other of the two tapes.

DESCRIPTION OF THE ACCOMPANYING DRAWINGS

DESCRIPTION OF THE EMBODIMENT

Figure 1:
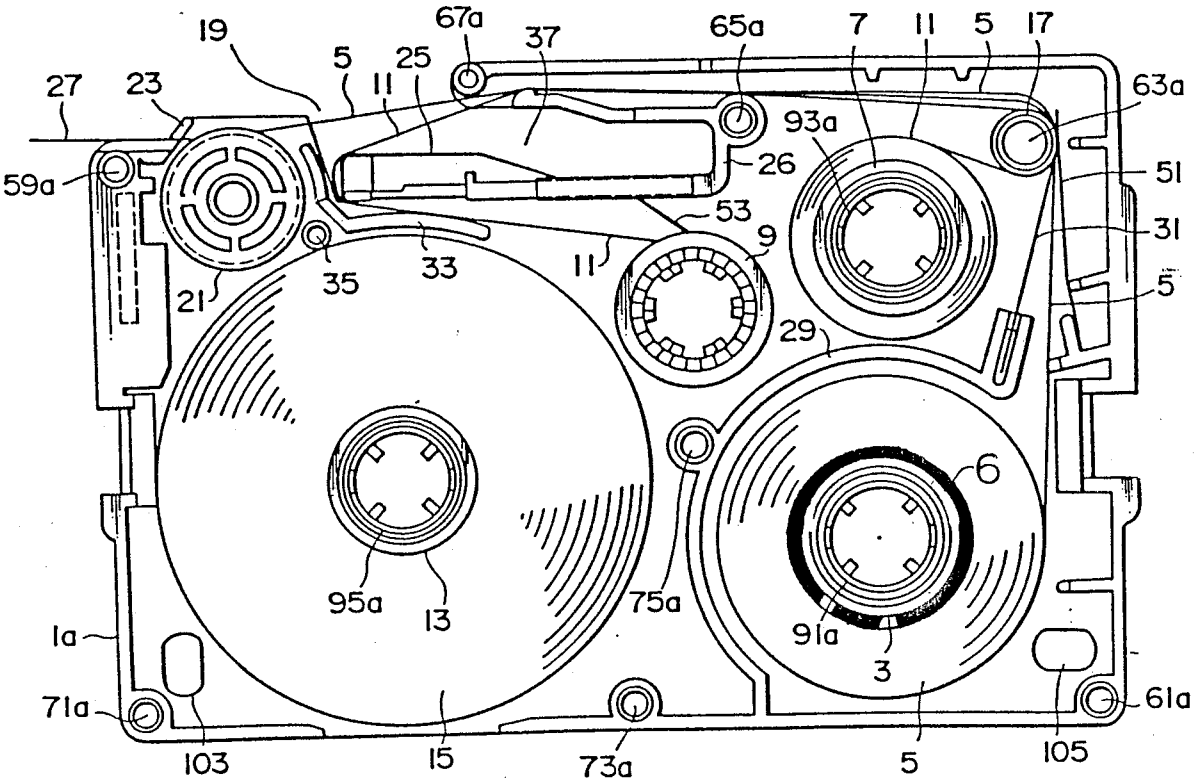
FIG. 1 is a general structural view of a tape holding case embodying the prsent invention.
Figure 2:
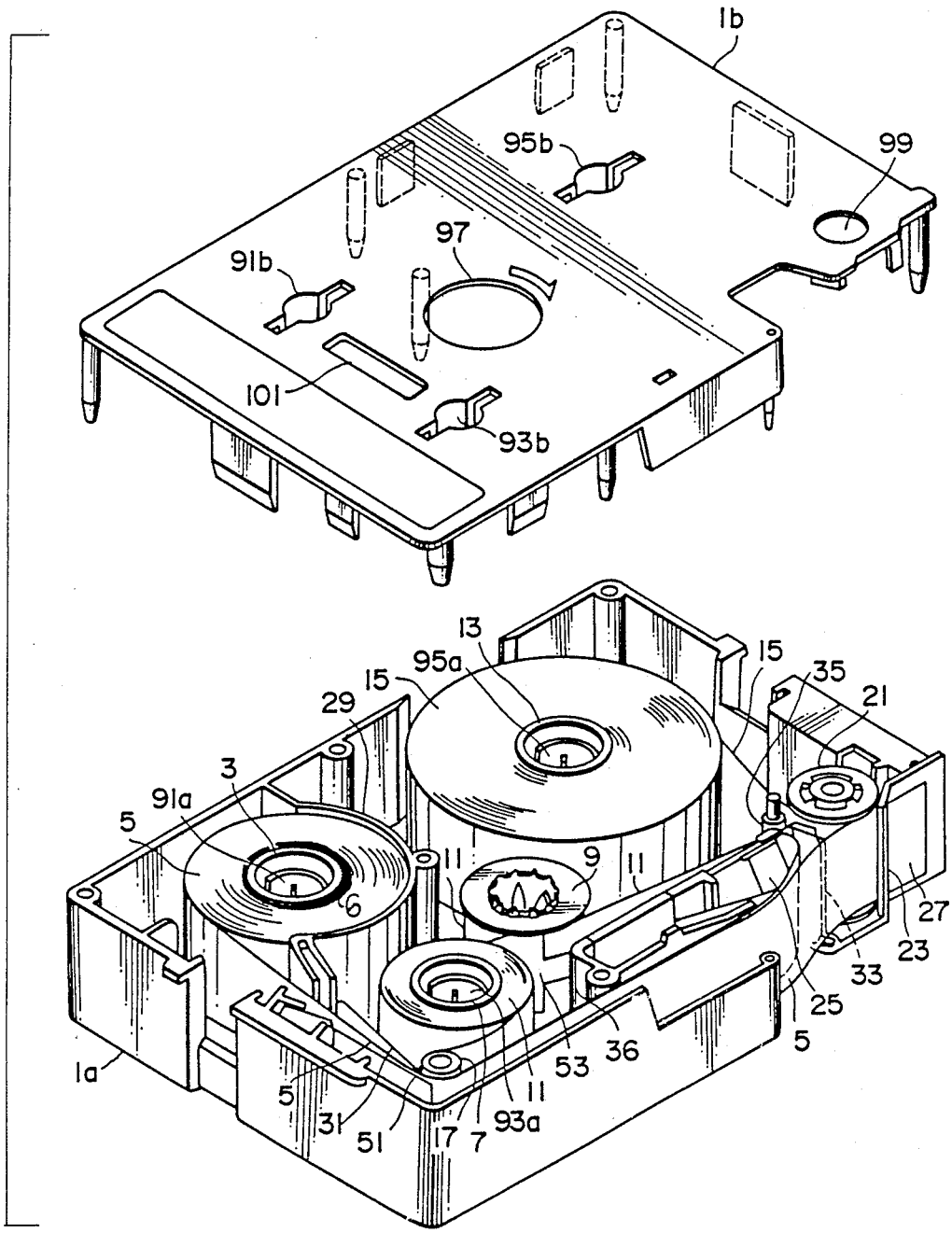
FIG. 2 is a perspective view of the tape holding case of FIG. 1; with a cover is removed.
Figure 3A:
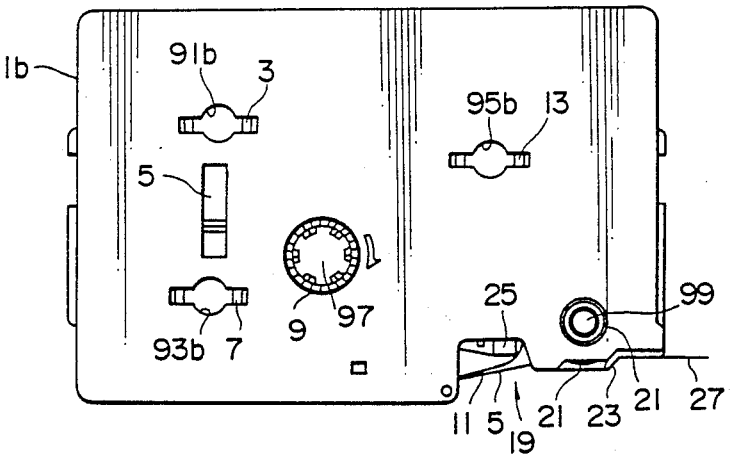
FIG. 3(A) is a plan view.
Figure 3B:
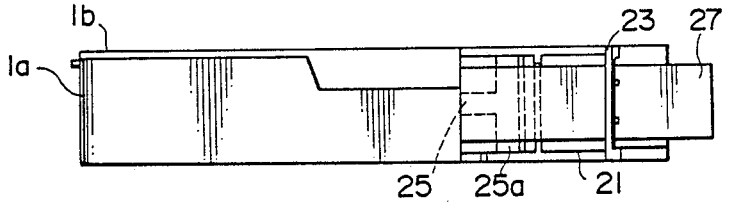
FIG. 3(B) is a front view.
Figure 3C:
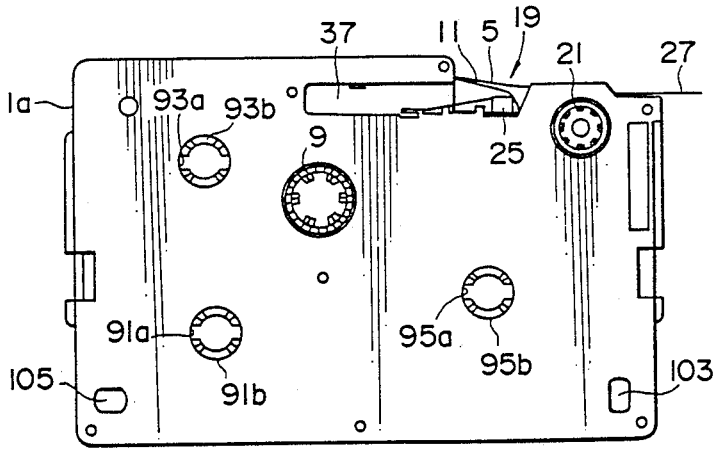
FIG. 3(C) is a bottom view of the tape holding case of FIG. 1.

The tape holding case embodying the present invention is now described with reference to the accompanying drawings.

A case body 1*a* carries therein the following three tapes for rotation with spools: (1) Transparent print tape 5 wound around a print tape spool 3. (2) Thermaltransfer ink ribbon 11 which is wound around a ribbon feed spool 7 with its inked surface facing inside before printing operation and taken up on ribbon take -up spool 9 after printing, and (3) Double-sided adhesive tape 15 wound on a double-sided adhesive tape spool 13 with its one side covered with an exfoliative sheet.

The print tape 5 is guided through the print tape spool 3 and a guide shaft 17 to a roller inlet 19 and further via a tape feed roller 21 passes through the slit under a tape holder 23 to exit. The ink ribbon 11 is guided through the ribbon feed spool 7 between the print tape 5 and the guide shaft 17 to the roller inlet 19, goes round a ribbon tension spring 25 and the end of a peripheral wall 26 to circulate through about 180 degrees in its feed direction and reaches the ribbon take-up spool 9. The double-sided adhesive tape 15 is guided through the double-sided adhesive tape spool 13 to the tape feed roller 21 and is stuck onto the print tape 5 to from a labeling tape 27 which then exits from the case.

The length relationship among these tapes 5, 11, and 15 is designed at factory as a following inequality;

$$L3 \geqq L2 > L1$$

where the wound length of the print tape 5 excluding an end tape 6, of which material or color is not the same as that of the print tape 5, serving as an end predicting mark: L1, the wound length of the ink ribbon 11 including the end tape 6: L2, and the wound length of the double-sided adhesive tape 15 including the end tape: L3.

The wound length here denotes the length actually wound on each spool 3, 7 and 13 and does not include the length of portions extending from each of spools.

Other structural components are now described below. An arc-shaped print tape storage wall 29 partially surrounding the print tape spool 3 is at one end securely provided with a base end of a film separator 31. The film separator 31 extends to separate the print tape 5 and the ink ribbon 11 from each other and is slightly inside the roller inlet 19.

Between the ink ribbon 11 and the double-sided adhesive tape 15 near the rollor inlet 19 provided is a separation wall member 33 and an adhesive tape roller 35. The separation wall member 33 is provided to prevent such a trouble that, when the flexible ink ribbon 11 is adhered to the adhesive surface of the double-sided adhesive tape 15, it is drawn out of the unit together with the double-sided adhesive tape 15, damaging the function of the tape storage cassette. The adhesive tape roller 35 consists of a pipe of silicon rubber or similar material easy to separate itself from an adhesive, which is rotatably carried by a shaft. This is provided to adjust the position of the double sided adhesive tape in a direction perpendicular to the feed direction to prevent the problem that, when the double-sided adhesive tape 15 is slackened, it is stuck on some part of the ink ribbon 11 or the tape holding case 1 making further feed of the double-sided adhesive tape 15 impossible.

Figure 4:
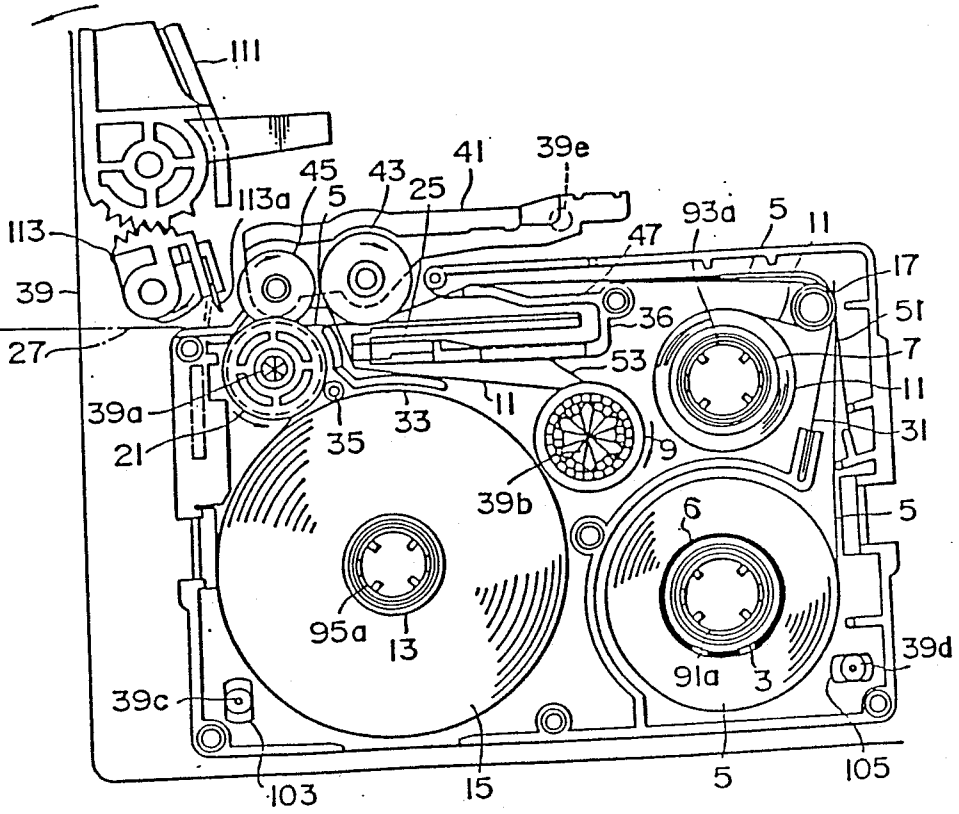
FIG. 4 is an operation explanatory view showing the tape holding case loaded in a printer unit with its cover removed.

Behind the roller inlet 19 formed is a print head insert slot 37 surrounded by the ink ribbon 11 and the peripheral wall 26, which opens to the bottom of a case body 1*a*. The roller inlet 19 allows, as shown in FIG. 4, a movable platen roller 43 and a drive roller 45 rotatably carried by a rockable roller holder 41 to partially enter the tape holding case 1 when the tape holding case 1 is mounted to a printer unit 39. The print head insert slot 37 enables a stationary print head 47 to be introduced from the back of the tape holding case 1 when the tape holding case 1 loaded in the printer unit 39.

At the guide shaft 17, a holder spring 51 born by the inner wall of the case body 1*a* applies a spring load to the ink ribbon 11, the film separator 31 and print tape 5 in this sequence from the guide shaft 17. This causes a back tension applied to the ink ribbon 11 and the print tape 5. However, the ink ribbon 11 and the print tape 5 are free from mutual influence during traveling because of the function of the film separator 31. The film separator 31 is also useful for preventing the ink on the ink ribbon 11 from being transferred to the print tape 5 even if the tape holding case 1 is mounted for long under high temperatures.

The ribbon take-up spool 9 is acted upon by a hold spring 53 born by the peripheral wall 26, which prevents slack of the ink ribbon 11 before being loaded in the printer unit 39 in association with the holder spring 51.

A cover 1*b* is provided with a plurality of fitting studs and plate elements vertically extending therefrom, which are fitted into the receiving holes and the side wall inside of the case body 1*a* to provide a firm connection between the cover 1*b* and the case body 1*a*.

Furthermore, the cylindrical fitting studs 91*b*, 93*b* and 95*b* at the cover 1*b* are fitted into the bore of the cylindrical fitting studs 91*a*, 93*a* and 95*a* passed through the spools 3, 7 and 13. This makes it impossible to turn the spools 3, 7 and 13 by hand from the outside of the tape holding case 1. This is because the tapes wound around the spools 3 and 13 are relatively rigid and travels constantly in drawing-out direction so that they are very unlikely to slack with no need of rewinding.

If the spools 3 and 13 were rotatable to allow rotation in wind-in direction, the ends thereof would be moved apart from the tape feed roller 21 so that the labeling tape 27 would no longer be fed out or, the print tape 5 might be taken into the double-sided adhesive tape spool 13 and vice versa because the leading ends of the print tape 5 and the double-sided adhesive tape 15 are adhered to each other. This might destroy the function of the tape holding case 1. This is because the spools 3 and 13 are designed to be free from manual rotation.

Also, the ribbon take-up spool 9 is at its end axially born by a bearing aperture 97 at the cover 1*b*, while the end of the tape feed roller 21 is axially born by a bearing aperture 99 of the cover 1*b*. With this arrangement, when the ink ribbon 11 becomes slack, it can be recovered from the slackened condition by inserting a pencil or the like in the bearing aperture 97 or the bearing aparture at the case body 1*a* and turning the ribbon take-up spool 9 in the wind direction. The reason why the ink ribbon 11 alone is designed to be manually windable lies in that the ink ribbon 11 is weak enough to be slackened easily, and once it become slack, the slackened state is maintained as it is because some tension is applied to the spools 7 and 9 by the holder springs 51 and 53 somewhat independently of each other.

An opening 101 at the cover 1*b* is provided to check for the remaining length of the print tape 5 and the ink ribbon 7 inside the tape holding case 1. Also provided are slots 103 and 105 provided at the bottom of the case body 1*a* for positioning the case in the printer unit 39.

Loading the tape holding case 1 of the structure as described above into the printer unit 39 and its operation are now described with reference to FIG. 4.

Loading into the printer unit 39 is carried out in the following steps: (1) Fitting a tape feed roller drive shaft 39*a* on the printer unit 39 into the tape feed roller 21 on the case 1. (2) Fitting a ribbon take-up spool drive shaft 39*b* on the printer unit 39 into the ribbon take-up spool 9 on the tape holding case 1, and (3) Fitting positioning projections 39*c* and 39*d* on the printer unit 39 into the slots 103 and 105. At the same time, the stationary print head 47 fixed in a present position of the printer unit 39 moves into the print head insert slot 37 from the back of the tape holding case 1.

During this movement of the stationary print head 47, the leading end of the stationary print head 47 abuts against a slope 25*a* of the ribbon tension spring 25 to withdraw the ribbon tension spring 25 away from the ink ribbon. Thus, the ink ribbon 11 does not interfere with the leading end of the stationary print head 47, completing the inward movement of the print head 47.

When the operator now swings the roller holder 41 about a rocker shaft 39*e* by means of a lever, not shown, on the printer unit 39, the movable platen roller 43 and the drive roller 45 are partially moved into the roller inlet 19 of the tape holding case 1.

The movable platen roller 43 moved into the tape holding case 1 overlays the print tape 5 and the ink ribbon 11 exposed to the roller inlet 19 on each other, and grips them with the end face of the stationary print head 47 on which a heating element is located.

Downstream thereof is the drive roller 45 in pressure contact with the tape feed roller 21 on the tape holding case 1 to lay the print tape 5 over the double-sided adhesive tape 15 and bond them together.

When the operator here executes printing by operating the printer unit 39, the drive mechanism, not shown, on the printer unitl 39 is operated to start rotation of the drive shafts 39*a* and 39*b*. At the same time, the heating element of the stationary print head 47 begins heating responsive to the printing pattern by operation of the print drive circuit not shown.

When the drive shaft 39a begins to rotate, the tape feed roller 21 is operatively associated with the drive roller 45 to bond the print tape 5 and the double-sided adhesive tape 15 together, and discharged a resultant laminated lebeling tape 27a from the printer unit 39 as indicated by the dot-dash line. Thus, the print tape 5 is withdrawn from theprint tape spool 3 simultaneously as the double-sided adhesive tape 15 is pulled out of the double-sided adhesive tape spool 13. At this time, the print tape 5 is visible from the operator's view as indicated by an arrow E. The adhesive surface of the double-sided adhesive tape 15 can also be seen through the transparent print tape 5.

On the other hand, as the drive shaft 39b rotates, the ribbon take-up spool 9 draws the ink ribbon 11 from the ribbon feed spool 7 by taking it up approximately at the same speed as the traveling speed of the print tape 5.

With the operation of the drive shafts 39a and 39b as discussed above, the print tape 5 and the ink ribbon 11 overlying each other travels between the movable platen roller 43 and the stationary print head 47 gripping them together.

With these tapes gripped as described above, ink coming from the ink ribbon 11 deposited on the print tape 5 in accordance with the desired heating pattern of a heating element.

With the tape, holding case 1 according to this embodiment operated in this manner, when all the tapes in storage are about to come to an end, the end tape 6 of the print tape 5 at first exits from the printer unit 39 according to the aforementioned expression ($L3 \geqq L2 > L1$). This visually informs the operator of the tapes about to run out to allow the operator to terminate printing and replace the cassette with a new one.

This arrangement thus prevents such troubles as stopping of ink ribbon 11 during printing, wear of the parts, break of ink ribbon 11 with its broken ends tangles together, soiling the stationary print head 47 and motor overhead. Since the ink ribbon 11 can be wound by hand as mentioned above, it is especially easy to be shorter than the initially set length. In this context, it is helpful to set $L2 > L1$ because the troubles as described above are likely to occur when setting the ink ribbon length to run out at the same timing as that of the print tape 5.

Since the double-sided adhesive tape 15 consists of an exfoliative sheet 15b having a considerable thickness and an adhesive layer 15a which also consists of several laminates to give a thickness, the end of the tape leaving the spool 13 is stretched because of tape run and develops some crease especially for the longest of double-sided adhesive tape 15. Such creases can be seen when used as the labeling tape 27a by bonding to the transparent print tape 5, significantly degrading the appearance of the label. Thus, the end tape of the print tape 5 is discharged from the printer unit 39 so as to terminate printing before such creases reach the bonded section.

Figure 5:
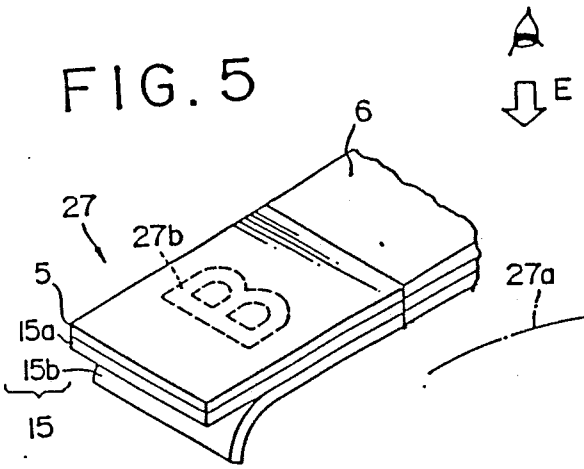
FIG. 5 is a structural view of a labeling tape to be produced by the printer unit mounting the tape holding case of FIG.1.

The labeling tape 27 discharged is of the structure, for instance, as shown in FIG. 5. The back face of the print tape 5 is formed with a print pattern 27b provided by ink on the ink ribbon 11. The adhesive layer 15a of the double-sided adhesive tape 15 is bonded to this section and the bottom layer is provided with the exfoliative sheet 15b of the double-sided adhesive tape 15.

The labeling tape 27 thus discharged is cut off in the following steps: When printing is terminated, a cutter lever 11 mounted on the printer unit 39 is turned in the direction indicated by an arrow F; a rotary cutter 113 movable with the lever is then rotated as indicated by the arrow F in the drawing to allow its blade 113a to be pressed against the outer face of the tape holding case 1 to sever the labeling tape 27, as indicated by the broken line. The labeling tape 27 thus produced can be stuck to any object or place when the operator peels off the release paper 15b.

While the foregoing embodiment presents an example of the tape holding case 1 for the labeling tape 27, if a transfer tape for lettering is to be produced, the tape holding case 1 houses therein only the print tape for lettering and the thermal-transfer ink ribbon with no need of double-sided adhesive tape 15.

Figure 6:
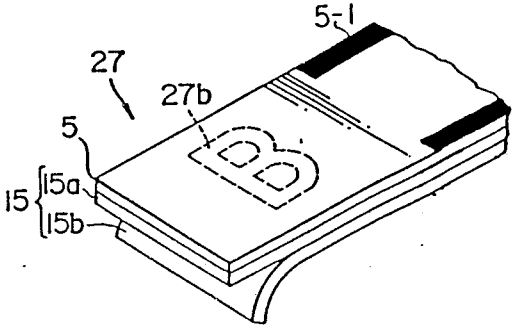
FIG. 6 is an illustrative view of a tape on which an indication pattern representing an ending side is printed.

Also, while in the foregoing embodiment, end tapes are provided as end predicting marks, they may be replaced with a special mark 5-1, as shown in FIG. 6, printed on the print tape 5. Since the print tape 5 is transparent according to the embodiment above, the end predicting marks can be printed or bonded on the adhesive layer 15a of the double-sided adhesive layer 15. If the adhesive layer 15a is also transparent, the mark can be provided on the exfoliative sheet 15b.

It is to be noted that if the operator views in the direction opposite to that indicated by the arrow E, the end predicting mark should be provided on the exfoliative sheet 15b. Again in this case, the mark can be put on the adhesive layer 15a if the exfoliative sheet 15b, and on the print tape 5 if the adhesive layer 15a is also transparent.

The same effect as with the embodiment above can be obtained if the length relationship among these tapes is set at factory as follows:

$$L3 \geqq L2 \approx L1 > Lm$$

where the wound length up to the end predicting mark of any tape provided with the end predicting mark: Lm, the wound length of the print tape including the end tape : L1, the wound length of the ink ribbon L2 including the end tape: L2, and the wound length of the double-sided adhesive tape including the end tape: L3.

What is claimed is:

1. A tape holding case adapted to be attachably and detachably mounted on a tape feed device having a roller member, said tape holding case including at least two tapes, means to bring said tapes into contact with each other at a predetermined position within said tape holding case; means to subsequently separate said tapes and feed one of said tapes outside of the tape holding case through said roller member provided on said tape feed device and another roller member provided within said tape holding case; means to wind the other of said two tapes onto said another roller member after said two tapes are contacted, and subsequently separated said one of said two tapes including a visually distinguishable predetermined portion at a trailing side arranged to be fed to the outside of said tape holding case before the whole of the other of said two tapes is taken up onto said another roller member.

2. The tape holding case according to claim 1 wherein said predetermined portion comprises an end mark provided on the ending side of the one of said two tapes.

3. The tape holding case according to claim 2 wherein said end mark comprises an end tape successively provided with said one of said two tapes.

4. The tape holding case according to claim 1 wherein said predetermined portion comprises a portion on which a predetermined pattern of indication is printed.

5. The tape holding case according to claim 4 which further includes an another tape in a wound state arranged to be overlapped with said printing tape by a pressure member provided on said tape holding case, before said printing tape is fed out from said tape holding case.

6. The tape holding case according to claim 5 wherein said pressure member comprises a roller adapted to be brought into and out of closer with said roller member.

7. The tape holding case according to claim 1 wherein said one of said two tapes comprises a printing tape on which a printing operation is executed by a print head member provided on said tape feed device, and wherein the other of said two tapes comprises an ink ribbon to be contacted with said printing tape at said predetermined position.

8. The tape holding case according to claim 7 further comprising another roller having a circumferential surface arranged to be brought into and out of contact with an adhesive layer of said double-sided adhesive tape, said surface being formed of a material which bonds with an adhesive force of less than a predetermined value with said adhesive layer in case that said circumferential surface and said adhesive layer contact each other.

9. A tape holding case adapted to be attachably and detachably mounted on a tape feed device , said tape holding case including three tapes and a roller member provided therein; means to feed a firs tape and a second tape outside of said tape holding case in an overlapped state and means to feed a third tape into contact with said first tape at a predetermined position within said tape holding case and sequently out of contact with said first tone and up onto said roller member provided within said tape holding case; said first tape including a visually distinguishable predetermined portion at an ending side thereof, the lengths of the three tapes being such that the predetermined portion of said first tape is fed outside of said tape holding case before the whole of the third tape is taken up onto said roller member.

10. The tape holding case according to claim 9 wherein said first tape comprises a printing tape on which a printing operation is executed by a printing member provided on said tape feed device, said second tape comprises a double-sided adhesive tape with an exfoliative sheet, and said third tape comprises an ink ribbon tape, and wherein said predetermined relationship among the values of the length of said three tapes is defined by a following inequality;

$$L3 \geqq L2 > L1$$

where,

L1: a value of length of said printing tape

L2: a value of length of said ink ribbon tape, and

L3: a value of length of said double sided adhesive tape.

11. The tape holding case according to claim 10 further comprising another roller having a circumferential surface arranged to be brought into and out of contact with an adhesive layer of said double-sided adhesive tape, said surface being formed of a material which bonds with an adhesive force of less than a predetermined value with said adhesive layer in case that said circumferential surface and said adhesive layer contact each other.

12. A tape feed mechanism comprising a tape feed device, a tape holding case attachably and detachably mounted on said tape feed device and including at least a first tape and a second tape, meant to feed said tapes within said tape holding case so as to contact each other at least at a predetermined position in said tape holding case and to sequently separate said tapes from contact; a roller member provided on said tape feed device , said first tape being further arranged to be fed outside of said tape holding case by said roller member provided on said tape feed device; said first tape having a visually distinguishable predetermined portion at an ending side thereof; another roller member provided within said tape holding case; said second tape being further arranged to be taken up onto said another roller member after said first and second tapes are separated from contact with each other, said tape feed mechanism being arranged in such a manner that said predetermined portion of said first tape is fed outside of said tape holding case before the whole of said second tape is taken up onto said another roller.

13. The tape feed mechanism according to claim 12 which further comprises a cutting member provided on said tape feed device for cutting said first tape having been fed out from said tape holding case.

14. The tape feed mechanism according to claim 12 wherein said first tape comprises a printing tape on which a printing operation is executed by a print head member provided on said tape feed device, and wherein said second tape comprises an ink ribbon to be contacted with said printing tape at said predetermined position.

15. The tape feed mechanism according to claim 12 which further includes a third tape in a wound state in said tape holding case, arranged to be overlapped with said first tape by a pressure member provided on said tape holding case before said first tape is fed out from said tape holding case.

* * * * *